United States Patent [19]

Schneider

[11] Patent Number: 4,960,379

[45] Date of Patent: Oct. 2, 1990

[54] PROCESS AND APPARATUS FOR OPENING FURNACE TAPHOLES

[75] Inventor: Werner Schneider, Siegen, Fed. Rep. of Germany

[73] Assignee: Dango & Dienenthal Maschinenbau GmbH

[21] Appl. No.: 304,661

[22] Filed: Jan. 31, 1989

[30] Foreign Application Priority Data

Feb. 6, 1988 [DE] Fed. Rep. of Germany ..... 3803625

[51] Int. Cl.[5] ..... F27D 1/16

[52] U.S. Cl. ..... 432/3; 266/45; 432/75; 432/248

[58] Field of Search ..... 432/3, 75, 76, 2, 50, 432/252; 266/45

[56] References Cited

U.S. PATENT DOCUMENTS

| | | | |
|---|---|---|---|
| 3,752,638 | 8/1973 | Van Laar et al. | 432/252 |
| 3,918,375 | 11/1975 | Hayakawa et al. | 432/75 |
| 3,990,836 | 11/1976 | Bricmont | 432/75 |
| 4,565,525 | 1/1986 | Van Laar et al. | 432/248 |

FOREIGN PATENT DOCUMENTS

| | | |
|---|---|---|
| 0041942 | 12/1981 | European Pat. Off. . |
| 2093292 | 1/1972 | France . |
| 2509449 | 1/1983 | France . |

OTHER PUBLICATIONS

Patent Abstracts of Japan, vol. 8, No. 41, Japanese Disclosure Publication No. 58-199807.

*Primary Examiner*—Henry C. Yuen
*Attorney, Agent, or Firm*—Toren, McGeady & Associates

[57] ABSTRACT

To open a furnace taphole that is closed by a body of plugging material and a tapping rod the tapping rod is driven into the interior of the furnace. Because the tapping rod is driven in and not withdrawn, it is not necessary to provide a second hammer striking blows in the opposite direction, but the hammer used to drive the tapping rod into the body of plugging material is again employed.

1 Claim, 4 Drawing Sheets

Fi

PROCESS AND APPARATUS FOR OPENING FURNACE TAPHOLES

TECHNICAL FIELD OF THE INVENTION

The invention relates to a process and apparatus for opening a furnace taphole that is closed by a body of plugging material and a tapping rod.

BACKGROUND OF THE INVENTION AND PRIOR ART

In the operation of blast furnaces and also of shaft furnaces for direct reduction, of boilers, as for example in coal gasification, of crucible furnaces or of low shaft furnaces for melting ferro-alloys, non-ferrous metals or non-metals, a tap hole must be opened after a certain period of time so that the melt or the by-products such as slag can run off. Depending on the process and the melting times, the length of the tapping cycle is between half an hour and several days. After tapping, the tapholes are again closed.

For alternate closing and opening of the tapholes of blast furnaces it is known from EP-OS-No. 41 942, to drive a rod, some minutes after the plugging of the taphole, through the as yet not fully hardened body of plugging material by means of a pneumatic hammer until the tip of the rod reaches the interior of the blast furnace, i.e. the melt.

While the part of the tip of the rod that comes into contact with the molten metal melts away, the remaining part of the tapping rod remains in the plug and is only withdrawn again on tapping.

It is known to use a taphole drilling machine to withdraw the tapping rod. Such machines are standard drilling machines having a striking hammer for driving in the tapping rod. However, to withdraw the tapping rod these taphole drilling machines must be equipped with a second hammer that strikes in the opposite direction to the hammer used for driving in. In addition a remotely controlled gripping device is required to grasp the tapping rod without an operator having to step into the tapping spout or channel for the crude iron. The gripping means and the hammer for driving in and withdrawing the tapping rods together form a compact device whose necessarily space-saving construction makes it very costly and also liable to break down.

To avoid the need for a two-hammer compact device, it has been proposed in EP-OS-No. 122 844 to withdraw the tapping rod from the taphole passage by means of the taphole plugging machine. However, since when withdrawing the tapping rod such machines complete their normal swinging movement, i.e. move in an arc of a circle from their working position at the taphole to a rest position, the rod cannot move in a straight line. The tapping rod is therefore always withdrawn from the taphole at an angle, which results in damage to the taphole and/or the tapping passage.

From U.S. Pat. No. 4 384 706 it is known to burn up the tapping rod with an oxygen lance instead of withdrawing it. However this process takes too long and is accompanied by considerable annoyance caused by smoke.

OBJECT OF THE INVENTION

The object of the invention is to provide a process and apparatus by which these disadvantages can be avoided when opening the taphole.

SUMMARY OF THE INVENTION

To this end, in a process according to the invention the tapping rod is driven into the interior of the furnace, where it is melted. All that is required for this is a device for moving the tapping rod into the furnace. The invention is thus based on the idea of opening the taphole by forcing the tapping rod inwards through the taphole passage. To drive the tapping rod into the interior of the furnace a conventional taphole drilling machine with a striking hammer can be used, i.e. there is no need to use a costly special construction as is needed for withdrawing the tapping rod.

To carry out the process it is advantageous to arrange a detachable guide piece on the front end of the striker rod of a ramming or percussion machine. The guide piece, for example a sleeve or a tube, can be attached by a spot weld or be stuck to the striker rod. According to a further proposal it may be clamped to the striker rod. The front end of the striker rod is placed up against the end of the tapping rod that faces away from the interior of the furnace, which is overlapped by the guide piece. When opposing forces act either on the clamping guide or the weld bead or the area of adhesion the guide piece is released and slides on the striker rod. A guide whose clamping force is automatically released or with fastening means that are automatically released makes it possible to drive the tapping rod into the furnace interior in an amazingly simple manner, without the necessity of coupling the tapping rod and the striker rod firmly together. If the tapping rod and the striker rod were to be coupled permanently together it would necessarily have to be accepted that the coupling head would melt away when dipped into the melt. In addition the dimensions of a permanent connection by means of a coupling head would have to be such that the coupling was smaller than the taphole passage so that it could enter the taphole passage.

In contrast to this, a non-coupled, loose abutment of the end faces of the two rods can be effected by means of a guide clamped to the front end of the striker rod, for example a clamping guide in the form of a sleeve or socket with radially acting springs, preferably having therein either one leaf spring or at least one pair of springs which advantageously includes two rod springs arranged spaced apart in a plane. The clamping guide, which is advantageously in the form of a sleeve with a centering bore and a clamp, ensures on the one hand that the loose coupling connection of the rods is held together, in that the centering bore overlaps the rear part of the end of the tapping rod that usually projects from the furnace, and on the other hand guarantees the guidance of the striker rod during the whole forward stroke. Alternatively a spring-loaded brake block can be used to clamp the striker rod. Care must always be taken that in the clamping guide the sleeve has a certain ability to stick on to the striker rod, but is nevertheless displaced on the striker rod when a certain clamping force is exceeded.

The tapping rod, which as a general rule projects from the outer wall of the furnace, is driven by the striker rod deeper into the furnace interior. As soon as the guide sleeve comes up against the outer wall of the furnace as it moves forward, an axial counter force exceeding the force of the clamp is built up, so that the sleeve is subsequently, i.e. on further penetration of the striker rod into the taphole passage, moved along the striker rod without preventing further forward movement. However the sleeve always serves to guide the striker rod.

The striker rod is preferably arranged in a drill carriage and coupled with a striking hammer. In this case the drill carriage that is in any event present can also be used to drive in the tapping rod. The striking hammer with a striker rod coupled to it is moved backwards until the end face of the guide sleeve remote from the furnace abuts against a stop on the drill carriage. On further withdrawal of the striker rod the force of the clamp in the sleeve is overcome and the striker rod slides through the guide sleeve, so that in the withdrawn end position of the striker rod the sleeve is again on the front end of the rod.

BRIEF DESCRIPTION OF THE DRAWINGS

The invention will now be described in more detail with reference to an exemplary embodiment illustrated in the drawings, in the case of a guide and connecting piece formed as a sleeve and clamped firmly to a striker rod. In the drawings:

FIG. 2 shows the striker rod of FIG. 1 moved forward until the guide sleeve is up against the outer wall of the furnace.

DETAILED DESCRIPTION OF PREFERRED EMBODIMENTS OF THE INVENTION

Figure 1:
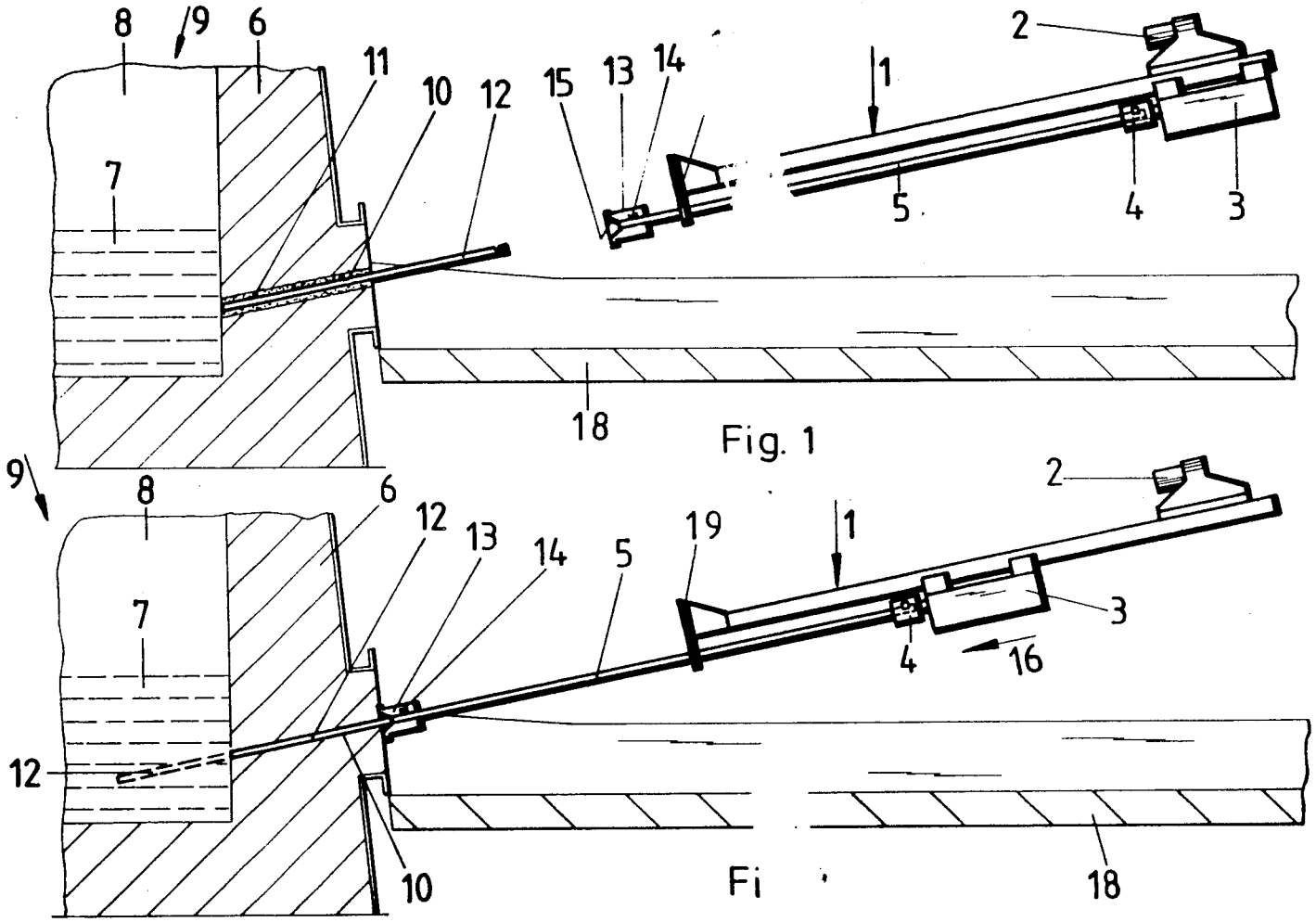
FIG. 1 shows a side view, partly in section, of a drill carriage with a striker rod according to the invention in the starting position before driving in a tapping rod located in a taphole passage of a furnace.
Figure 3:
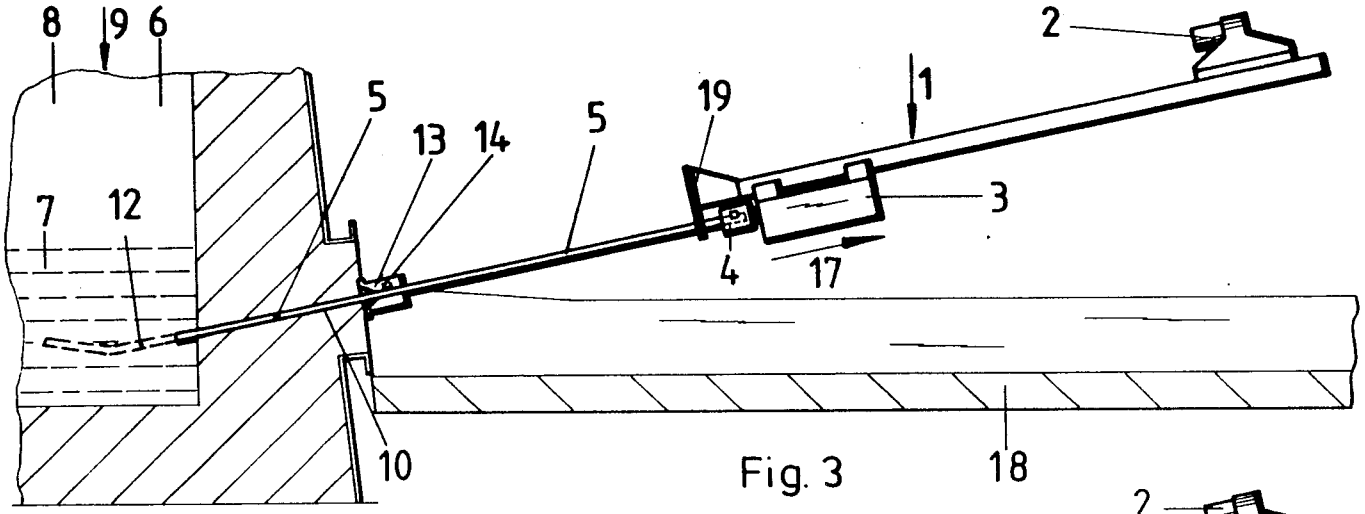
FIG. 3 shows the striker rod of FIG. 1 in a working position in which it has penetrated through the taphole passage into the furnace interior.
Figure 4:
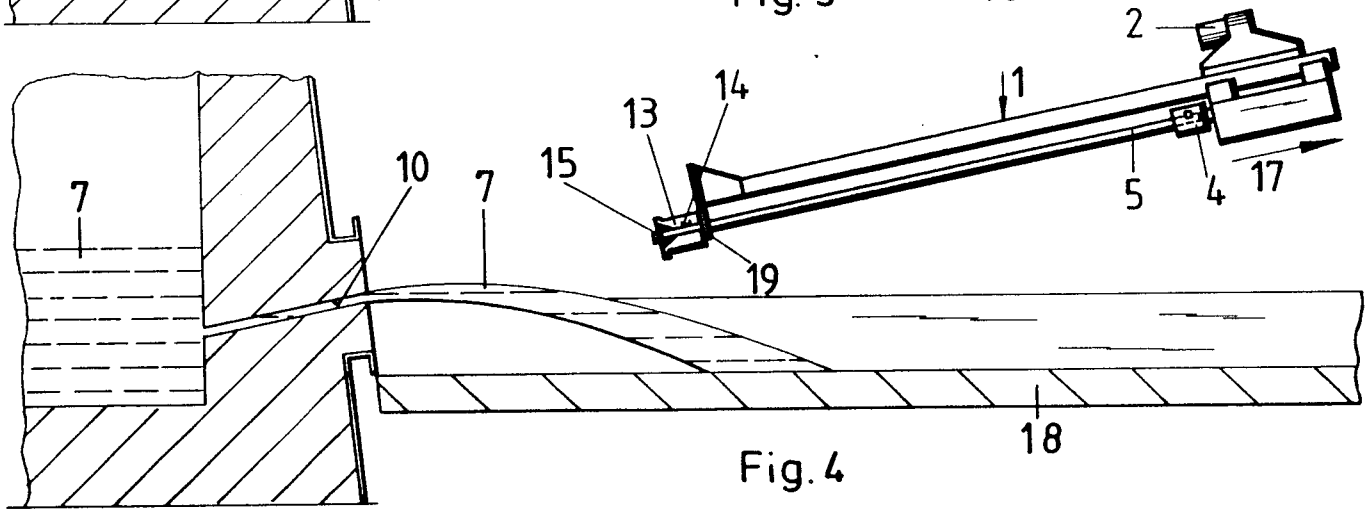
FIG. 4 shows the striker rod of FIG. 1 withdrawn to its starting position after opening the taphole.

A drill carriage 1 with a striking hammer 3 arranged to slide in a guide and moved by a feed motor 2, and connected to a striker rod 5 by a coupling 4 is shown in FIG. 1 in a working position before the opening of a taphole passage 10 that passes through the refractory lining 6 of a blast furnace into its interior 8, which is filled with a melt 7. The taphole passage 10 is closed by a plug 11 and a tapping rod 12 embedded therein. Since after it has hardened the plug 11 forms an integral part of the refractory lining 6, FIGS. 2 to 4 are drawn without a plug. The free end of the tapping rod 12 projects outwards from the plug or the taphole. Onto the front end of the striker rod 5 of the drill carriage, which is aligned with the tapping rod 12, a guide sleeve or socket 13 is coupled by means of a clamp 14. The end face of the guide sleeve 13 facing the tapping rod 12 is provided with a centering bore 15 that narrows towards the interior.

When the striking hammer 3 is moved forward in the direction of feed 16 by means of the motor 2 the front end face of the striker rod 5 comes up against the projecting end of the tapping rod 12: this aligned contact of the two rods 5, 12 is assisted by the centering bore of the guide sleeve 13 that overlaps the end of the tapping rod 12. The striking hammer 3, for example a reversible striking piston (not shown) which transfers its impact energy to the striker rod 5, drives the striker rod 5 and consequently the tapping rod 12 further and further in the feed direction as the taphole is opened.

In the advanced position shown in FIG. 2 the guide sleeve 13 abuts against the furnace 9: the part of the tapping rod shown in broken lines has already been driven into the melt 7 and melted away. Because of the abutment on the refractory lining 6 the guide sleeve 13 cannot move any further forward as the striker rod 5 is further advanced. Instead the clamp 14 ceases to be effective and the striker rod 5 can slide through the guide sleeve 13 and drive the tapping rod 12 wholly into the interior of the furnace 9. This position, in which the tapping rod 12 (shown in broken lines) is completely inside the metal melt 7, is shown in FIG. 3.

By reversing the feed motor 2 the striking hammer 3 is then moved in the direction of the arrow 17 and withdraws the striker rod 5 coupled to it from the taphole passage 10 until the taphole has been freed, so that the melt 7 can run out into the tapping spout or runner arranged below the passage (see FIG. 4). On pulling the striker rod 5 back in the direction of the arrow 17 the guide sleeve 13 comes up against a stop 19, e.g. a heat shield, of the drill carriage 1: this stop position limits the movement of the guide sleeve 13 on further withdrawal of the striker rod 5 and, as a result of the counter force that is set up, overcomes the clamping action, so that the striker rod 5 moves through the guide sleeve 13.

In the striking position of the striker rod shown in FIG. 4 the guide sleeve is then again at the front end of the striker rod 5, and a new driving-in operation can be started from this position.

Figure 5:
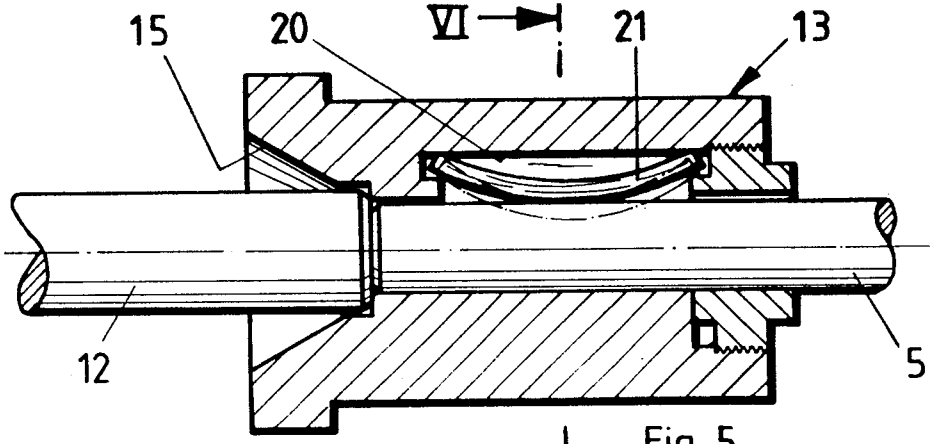
FIG. 5 shows as a detail and in longitudinal section a sleeve with a leaf spring as clamp.
Figure 6:
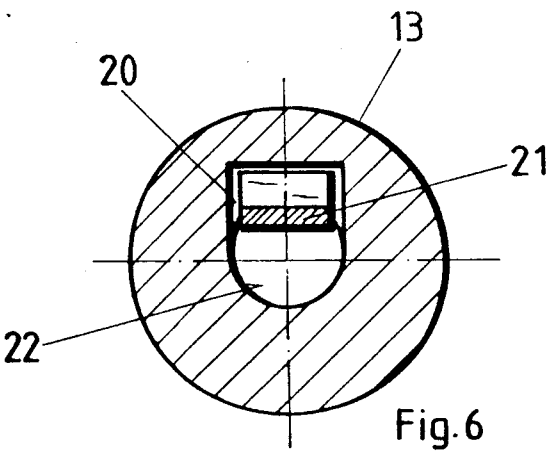
FIG. 6 shows a section along the line VI—VI in FIG. 5 with the leaf spring unloaded.
Figure 7:
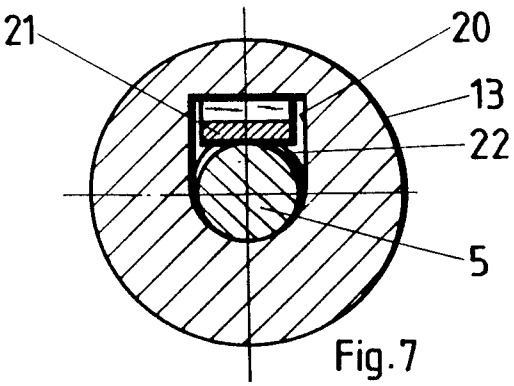
FIG. 7 shows a section as in FIG. 6 with a striker rod inserted and the leaf spring loaded.

In the case of the clamping guide shown in FIGS. 5 to 7, a leaf spring 29 extending along the longitudinal axis of the striker rod 5 is arranged in a recess 29 in the sleeve 13 to clamp the striker rod 5. As shown in dot-dash lines in FIG. 5, the leaf spring 21, which is in the starting position (see FIG. 6) is unloaded, bulges out into the through bore 22 for the striker rod 5. On introducing the striker rod 5 into the bore 22 the leaf spring is radially loaded and thereby prestressed, so that it finally takes up the stressed position shown in full lines in FIG. 5 in which it exerts a clamping force on the striker rod 5.

Figure 8:
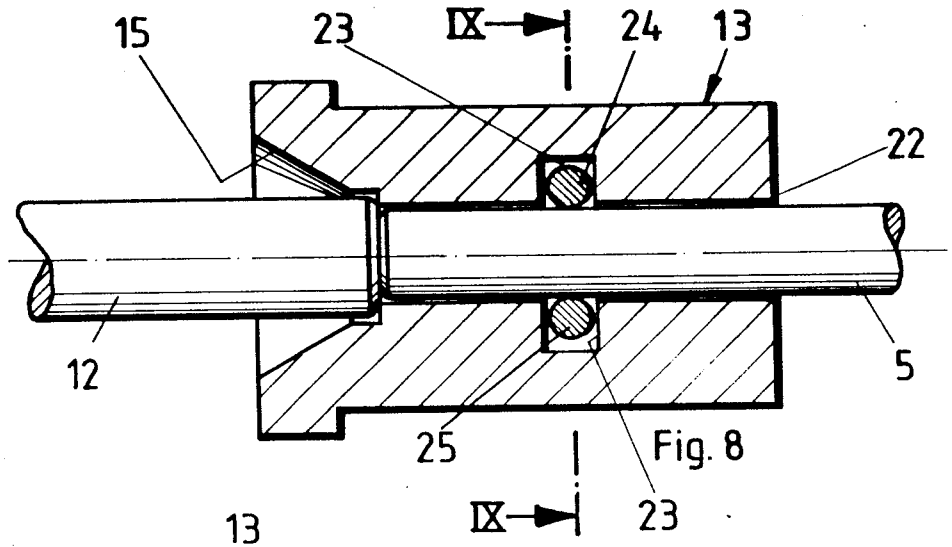
FIG. 8 is a detail showing a sleeve with two bar springs.
Figure 9:
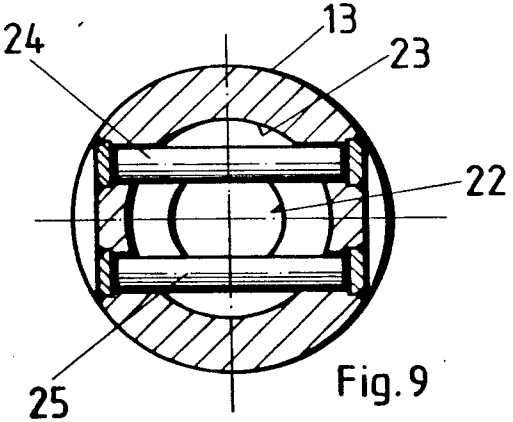
FIG. 9 shows a section along the line IX—IX in FIG. 8 with the bar springs unloaded.
Figure 10:
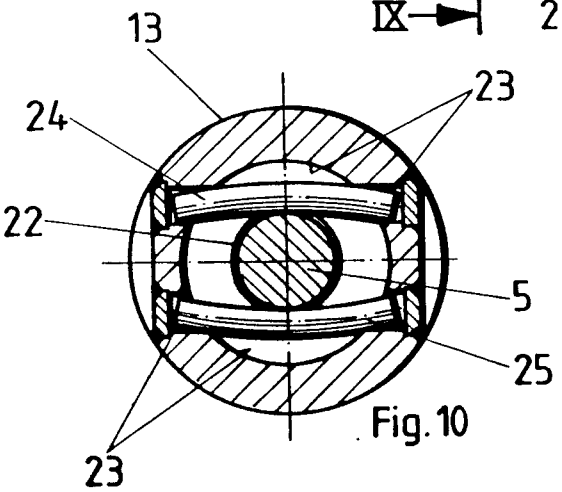
FIG. 10 shows a section as in FIG. 9 with a striker rod inserted and the bar springs loaded.

In the clamping guide according to FIGS. 8 to 10 two bar springs 24, 25 are arranged in radial recesses 23 in the sleeve 13 to clamp the striker rod. The bars 24, 25 extend transverse to the longitudinal axis of the striker rod 5 and the through bore 22 in a plane and spaced apart by a distance that is smaller than the diameter of the bore 22 (FIG. 9). On introducing the striker rod into the bore 22 of the sleeve 13 the bar springs 24, 25 are forced radially outwards by the striker rod 5 (FIG. 10) and thereby prestressed, so that they clamp the striker rod 5.

What is claimed is:

1. A process for opening a furnace taphole that is closed by a body of plugging material and a previously positioned tapping rod, comprising the steps of:

driving the tapping rod completely through the taphole into the interior of the furnace; and melting the rod down in the furnace by the heat of a liquid in the furnace.

* * * * *